US005988465A

United States Patent [19]

Vitale et al.

[11] Patent Number: 5,988,465

[45] Date of Patent: Nov. 23, 1999

[54] BACKPACK ASSEMBLY AND METHOD OF USE

[76] Inventors: Richard Vitale; Eugene Vitale, both of 8118 Tortuga La., Boynton Beach, Fla. 33436

[21] Appl. No.: 09/092,026

[22] Filed: Jun. 5, 1998

Related U.S. Application Data

[60] Provisional application No. 60/051,452, Jul. 1, 1997.

[51] Int. Cl.[6] ..... A45F 4/02

[52] U.S. Cl. ..... 224/155; 224/584; 224/153; 224/907; 297/188.2; 297/129

[58] Field of Search ..... 224/153, 155, 224/581–584, 627, 642, 644, 645, 650, 652, 654, 657, 907, 620; 297/188.12, 188.2, 219.1, 129

[56] References Cited

U.S. PATENT DOCUMENTS

| | | | |
|---|---|---|---|
| 2,865,433 | 12/1958 | Warner | 297/219.1 X |
| 3,143,748 | 8/1964 | Manning . | |
| 3,185,362 | 5/1965 | Wakefield . | |
| 4,236,657 | 12/1980 | Brunton . | |
| 4,588,224 | 5/1986 | Hill, Jr. . | |
| 4,854,637 | 8/1989 | McCree | 297/188.2 |
| 4,925,064 | 5/1990 | Comora . | |
| 4,925,241 | 5/1990 | Geraci | 297/219.1 X |
| 5,119,910 | 6/1992 | Heggeland | 224/620 X |
| 5,573,155 | 11/1996 | Sadler . | |
| 5,584,422 | 12/1996 | Bond-Madsen . | |
| 5,588,570 | 12/1996 | Zirbel . | |
| 5,620,227 | 4/1997 | Brune | 224/155 X |
| 5,819,999 | 10/1998 | Tennant | 224/155 |

*Primary Examiner*—Gregory M. Vidovich
*Attorney, Agent, or Firm*—Richard C. Litman

[57] ABSTRACT

A backpack assembly having a backpack, and a pad and a retaining strap, both connected to the backpack. The backpack has a front panel secured to a back panel, with a chamber defined between the panels, the front panel having a top, a bottom, and opposite sides. The backpack includes a pair of shoulder straps secured to the backpack such that, with the straps positioned over the shoulders of a person, the front panel faces and is generally parallel to the back of the person while the backpack is worn. The pad includes a first face and a second face, with the pad being connected to the backpack by at least one pad strap, such that the pad is movable between a first position, where the first face contacts the front panel, and a second position, where the first face is placed on a chair seat and the backpack rests upon a horizontal support surface. The retaining strap includes a fixed end connected to the backpack adjacent the top of the front panel, and a free end. The free end has a fastener for mating with one of two fasteners, these being one fastener located on the back panel of the backpack, while the pad is in the first position, and another fastener on the first face of the pad, while the pad is in the second position.

15 Claims, 4 Drawing Sheets

BACKPACK ASSEMBLY AND METHOD OF USE

CROSS-REFERENCE TO RELATED APPLICATION

This application claims the benefit of U.S. Provisional Patent Application Ser. No. 60/051,452, filed Jul. 1, 1997.

BACKGROUND OF THE INVENTION

1. Field of the Invention

The present invention generally relates to backpacks. More specifically, the invention is a multi-purpose backpack for use in various environments.

2. Description of Related Art

Backpacks are often used by students to carry heavy and/or oddly shaped books. With several books in the backpack, the load will oftentimes become uncomfortable to the user, as such books contact the user's back when the pack is worn. To overcome this problem, backpacks may be provided with a layer of padding to minimize discomfort. Such padding is typically sewn into a portion of the back which normally rests against the user's back during normal use. Such padding, however, cannot provide any additional comfort to the user when the pack is not being worn on the user's back. For instance, many students must remain seated in uncomfortable chairs for an hour or more during the course of a class or lecture. During the time spent in a chair, the padding of the backpack is incapable of providing a user with the opportunity to cover and soften the chair seat. Therefore, there is a need for a backpack having an integral, adjustable cushion which a user may manipulate into a first position where the cushion is secured to the pack for placement against the user's back while the pack is worn and a second position where the cushion may be secured to a chair seat.

The related art contains a number of backpack and fannypack devices having an integral seat cushion thereon. U.S. Pat. No. 3,185,362 issued to Wakefield on May 25, 1965 discloses a combination seat pack which includes an adjustable belt and a foldable portion secured to the belt. The foldable portion has one segment in the form of a pocket with closure means, and several additional segments which may be removably secured to the one segment in a raised position or freely depending therefrom in a suspended position.

U.S. Pat. No. 4,588,224 issued to Hill, Jr., on May 13, 1986 discloses a belt-attached seat pad. The seat pad includes a layer of foam covered by waterproof fabric, and a first pair of strips secured to the top edge of the pad and a second pair of strips secured to the bottom edge of the pad. The first pair of strips are used to suspend the pad from a user's belt, and the second pair of strips are used for moving the pad between folded (walking) and unfolded (seated) positions.

U.S. Pat. No. 3,143,748 issued to Manning on Aug. 11, 1964 discloses a combination container and cushion. One embodiment of the device is formed from a thick flat sheet may be opened to provide a cushion, or folded upon itself and connected at its edges in a manner to form a container or bag.

U.S. Pat. No. 4,236,657 issued to Brunton on Dec. 2, 1980 discloses a backpack having a flap along one rear side thereof and a pair of leaves hingedly connected to the flap by a zipper. Together the pair of leaves form an envelope which may be used for storage, and they may be wrapped around the backpack so that overlapping portions may be fastened together.

U.S. Pat. No. 5,588,570 issued to Zirbel on Dec. 31, 1996 discloses a combination backpack and seat device. The backpack includes a frame formed from two members, these being a first member attached to the backpack for structural support, and a second member removably attachable to the first member and capable of being stored within the backpack. When attached together, the frame members form an L-shaped structure that supports the backpack so that it may function as a backrest. A cushion, connected to the backpack at its lower edge, may be folded down to create a padded seat. The cushion may be secured against the backpack to cushion the wearer's back while the backpack is worn.

U.S. Pat. No. 5,584,422 issued to Bond-Madsen on Dec. 17, 1996 discloses a combination backpack and chair cover which includes a plurality of interconnected panels capable of being folded and secured together in a first position, where panels form a backpack, and opened into a second position, where the interconnected panels are configured to form a chair cover.

U.S. Pat. No. 5,573,155 issued to Sadler on Nov. 12, 1996 discloses a backpack assembly including a backpack and a pad assembly removably secured to the backpack. The panel assembly includes a first portion pivotally secured to a second portion such that the pad assembly may be moved from a first position to a second position. In its first position, the first portion overlies the second portion and both are secured to the backpack by a multitude of straps so that a user may wear the backpack with the pad assembly providing cushioning to the user's back. In the second position, the pad assembly is positioned with the first portion against a seat back and the second portion upon a seat. In the second position, the pad assembly is secured to the backpack with the backpack positioned behind the chair, inaccessible to the user.

None of the above inventions and patents, taken either singly or in combination, is seen to describe the instant invention as claimed.

SUMMARY OF THE INVENTION

The backpack according to the invention includes an integral, adjustable cushion which a user may manipulate into at least two useful positions, a first position where the cushion is secured to the pack for placement against the user's back while the pack is worn, and a second position where the cushion is secured to a seating surface, e.g., a chair seat or the like. In accordance with the below-stated objectives, the backpack is of a generally conventional design having a pad connected to the backpack, and a retaining strap also connected thereto. The pad and retaining strap are connected to the backpack such that the pad may be manipulated between a first position and a second position, with the retaining strap retaining the pad in each of the first and second positions.

The backpack includes a front panel and a corresponding back panel which are secured together to form an article carrying chamber therebetween. The front panel includes a top, a bottom, and two spaced apart sides. The front panel and back panel are also provided with a zipper or other conventional closure means which provide selective access to the chamber. The backpack also includes a pair of shoulder straps that extend, respectively, from the top of the front panel to a location adjacent to the intersection between the bottom and the opposed sides. Each shoulder strap is additionally provided with a buckle or other like adjustment means.

The pad has a first face and an opposite second face. The pad is connected to the backpack by at least one pad strap, and more preferably, two pad straps which are spaced apart along the top of front panel. Each pad strap has one end which is secured to the backpack adjacent the top of the front panel, and an opposite end which is secured to one end of the pad. Together the pad straps allow the pad freely to move between the first position and the second position. The first face of the pad and the front panel of the backpack each include a corresponding fastener. The first face is provided with at least one fastener and, preferably, two fasteners. The front panel is likewise provided with at least one fastener and, preferably, two fasteners which are positioned for mating engagement with the fasteners of the first face when the pad is folded into the first position.

The retaining strap has one end thereof connected to the backpack adjacent the top of the front panel, and an opposite end which is free. Attached to the free end is a fastener which is adapted to mate with one of two other fasteners. While the pad is in the first position, the retaining strap may optionally be disposed external of the pad to further secure the pad to the backpack and the free end thereof is wrapped beneath the backpack so that the fastener thereon may mate with a fastener attached to the back panel of the backpack. While the pad is in the second position, the retaining strap is positioned to secure the pad to object such as a chair seat or other seating surface and the free end thereof is wrapped partially around the seating object so that the fastener thereon may mate with a fastener attached to the second face of the pad.

The backpack assembly is intended to be worn by a user with the backpack carried on his back. To carry the backpack assembly on his back, a user configures the pad into the first position and retains the pad in such position [with the retaining strap]. To secure the pad in the first position, the user will first lay the pad against the backpack such that the first face of the pad confronts the front panel of the backpack. When this is accomplished the fasteners of the first face will align and mate with the fasteners of the front panel. Next, the user will wrap the retaining strap under the second face of the pad, about the bottom of the front panel, and partially over the back panel until the fastener of the retaining strap free end aligns and mates with the fastener of the back panel. With the pad retained in the first position, the backpack assembly is worn with the pad between the backpack and the user's back.

The backpack assembly also is intended to be utilized with the pad serving as a seat cushion in a secure fashion and the backpack positioned conveniently beside a chair seat, resting upon a horizontal support surface with its contents readily accessible. To utilize the pad as a seat cushion, a user configures the pad into the second position and retains the pad in such position with the retaining strap. Upon setting the backpack upon a horizontal support surface beside the chair seat, the retaining strap is removed from its position whereby the fastener on the free end thereof is mated with the fastener of a back panel portion of the cushion. This allows the user to move the pad from the first position to the second position, where the pad is placed onto the chair seat or the like. With the pad placed onto the chair seat with the second face thereof being upwardly exposed, the user will then pull the retaining strap beneath the chair seat and around the opposite side of the chair seat until the fastener on the free end thereof aligns and mates with the fastener on the first face of the pad. With the pad retained in the second position, the pad may serve as a seat cushion while the backpack is positioned conveniently upright and beside the chair seat with its contents readily accessible. The retaining strap is composed of a stretchable material which can be twisted or stretched as needed for fastening the strap to the cushion.

Accordingly, it is a principal object of the invention to provide a backpack assembly which includes a pad for cushioning the user's back while the pack is worn and cushioning of a chair seat or the like while the pack is off the user's back.

It is another object of the invention to provide a backpack assembly which is simply and easily convertible between a first position when the pack is ready for transporting upon a user's back and a second position when the pack may be placed beside a chair seat or the like for access to the pack and for cushioning of the chair seat.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

Detailed Description of the Preferred Embodiment

Figure 1:
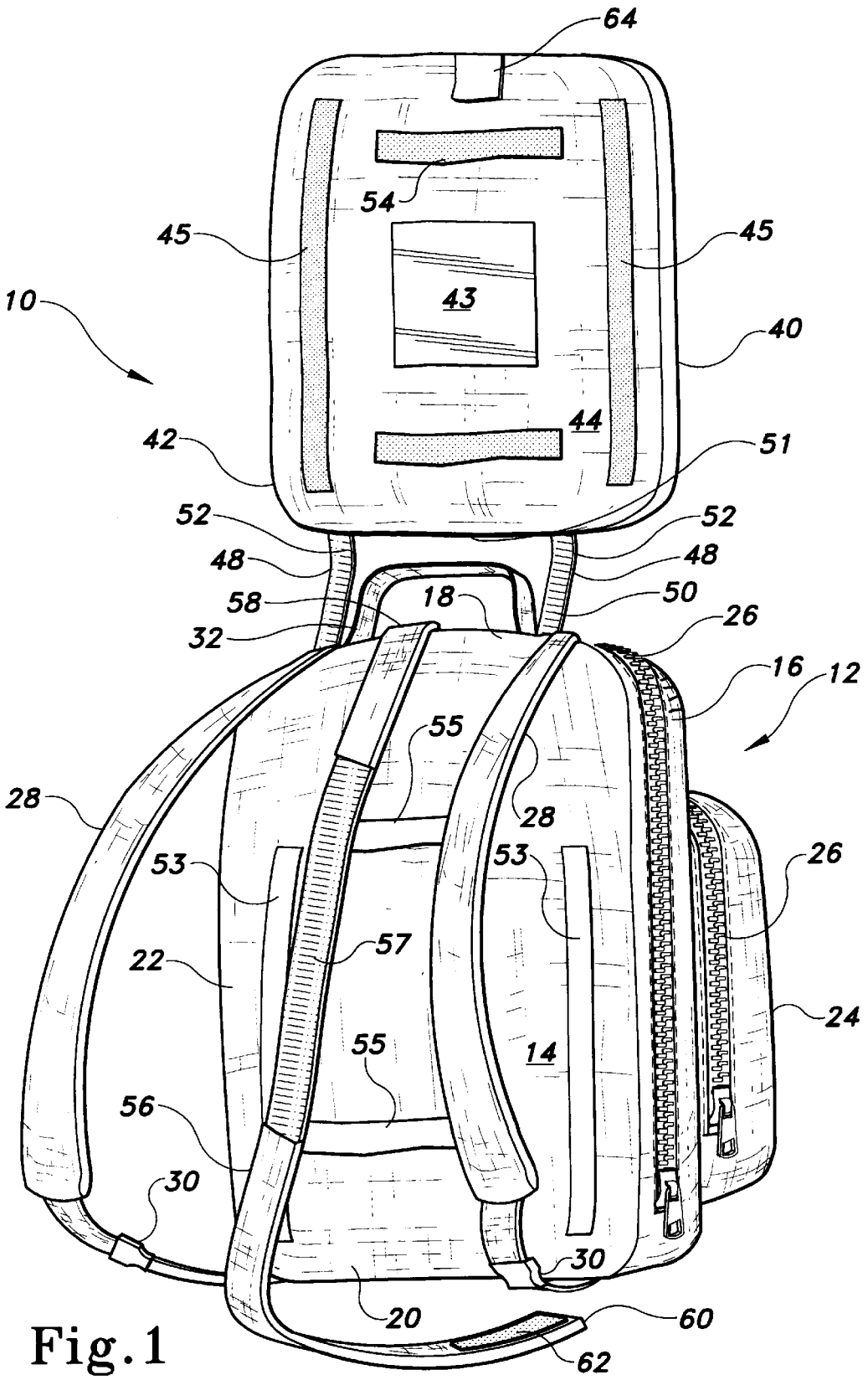
FIG. 1 is a rear perspective view of a backpack assembly of the present invention, with its attached pad raised to expose a front panel of the pack.

Referring now to the drawings by numerals of reference and first to FIG. 1, 10 generally denotes a backpack assembly of the present invention. The backpack assembly 10 generally comprises a backpack 12, a pad 40, and a retaining strap 56, which are intended to be manipulated by a user for retention of the pad in a first position and a second position. In the first position, the pad is retained against the backpack so that it may provide cushioning to the back of the user while the backpack is worn. In the second position, the backpack is placed adjacent a chair seat and the pad is retained against the chair seat to provide cushioning while the user remains seated on the chair seat, at which time the backpack remains accessible.

The backpack 12 includes a front panel 14 and a corresponding back panel 16 which are secured together to form an article carrying chamber therebetween (not shown). The front panel 14 includes a top 18, a bottom 20, and two spaced apart sides 22. The front panel 14 and back panel 16 are also provided with a zipper 26 or other conventional closure means which provides selective access to the chamber. The front and back panels 14, 16 may be formed of any heavy-duty, woven fabric materials of the type conventionally used on backpacks and other carrying devices. The back panel may also contain an additional pocket 24 formed thereon. Attached adjacent the top 18 of front panel 14 is a handle 32 which a user may utilize to grasp or hang the backpack 12.

The backpack 12 includes a pair of shoulder straps 28. One strap extends from the top 18 of the front panel 14 to a location adjacent to the intersection between the bottom 20 and one side 22. The other strap extends from the top 18 of the front panel 14 to a location adjacent to the intersection between the bottom 20 and the other side 22. The pair of shoulder straps 28 are symmetrically spaced apart between the opposite sides 22 of the front panel 14. Each shoulder strap 28 is additionally provided with a buckle 30 or other like adjustment means.

It will be apparent to those skilled in the art that the exact location of the shoulder strap 28 with respect to the intersection of the bottom 20 and sides 22 will depend upon the size and particular design considerations involved in the construction of the backpack 12. However, as described thus far, the backpack 12 is of a conventional design for smaller day packs and book packs preferred by most students.

Figure 2:
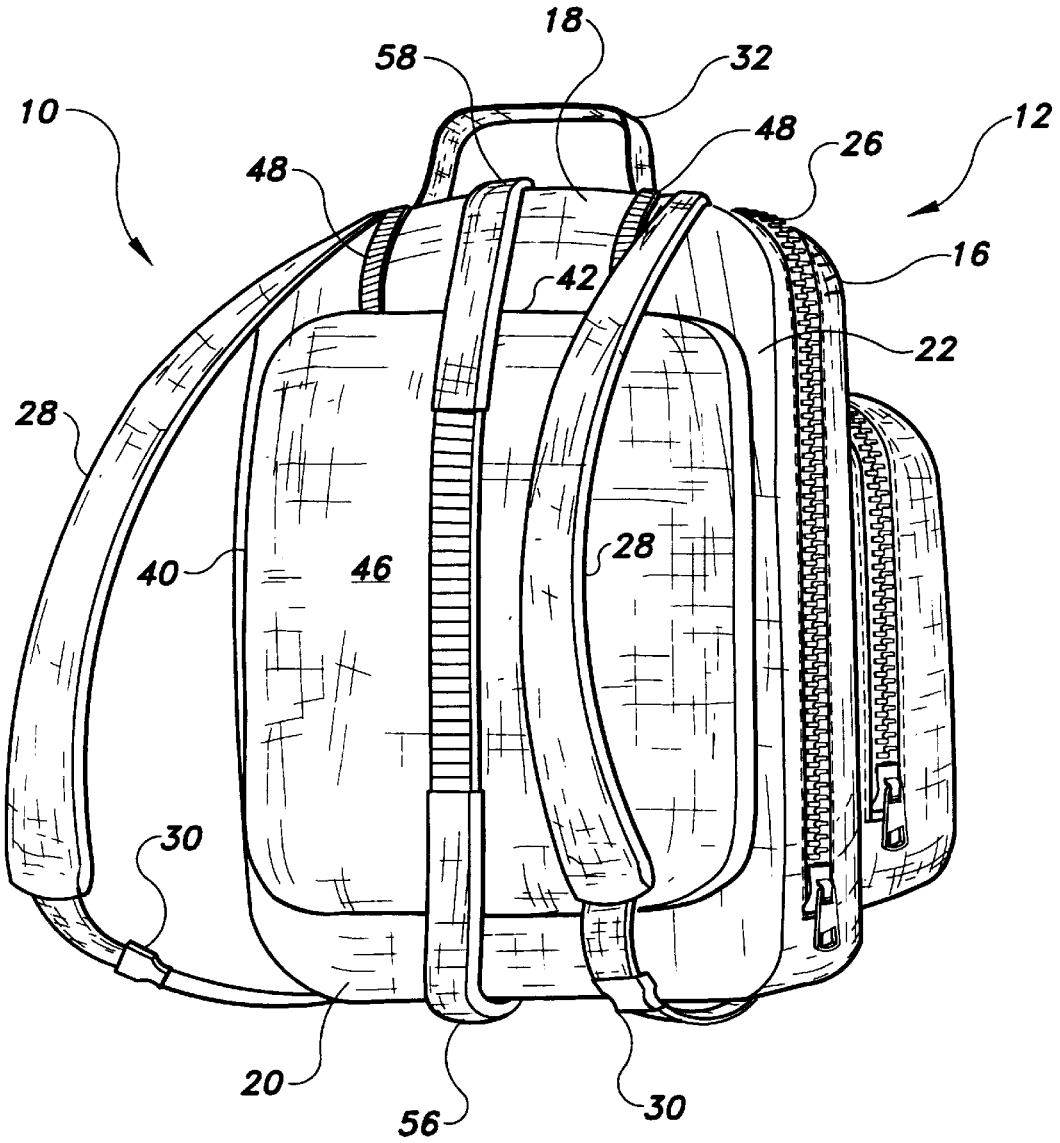
FIG. 2 is a rear perspective view of the backpack assembly shown with its pad retained against the pack in a first position.

Referring now to FIGS. 1 and 2, the backpack assembly 10 also includes the pad 40 and the retaining strap 56. The pad 40 is preferably formed of a resilient foam cushion surrounded by a fabric outer layer that prevents deterioration of the resilient foam cushion. The pad 40 has a first face 44 and an opposite second face 46 (shown at FIG. 2). The pad 40 is connected to the backpack 12 by at least one pad strap 48 and more preferably, as shown, two pad straps 48 which are spaced apart along the top 18 of front panel 14. The pad straps 48 are formed of a conventional flexible material which is sufficiently durable, such as woven nylon. However, the pad straps 48 may also be formed with an elastic material which allows the straps to be stretched while the pad 40 is moved between the first and second positions. Each pad strap 48 has one end 50 which is secured to the backpack 12 adjacent the top 18 of the front panel 14, and an opposite end 52 which is secured to one end 51 of the pad 40. Together the straps 48 allow the pad 40 freely to move between the first position and the second position, as described more fully hereinafter.

As shown in FIG. 1, the first face 44 of the pad 40 and the front panel 14 of the backpack 12 each include a corresponding fastener. The first face 44 is provided with at least one fastener disposed in a horizontal direction and at least one fastener 45 disposed in a vertical direction, and a non-skid material 43 which preferably serves to prevent the first face 44 from sliding off a seating surface. The front panel 14 is likewise provided with at least one fastener 55 disposed in a horizontal direction and at least one fastener 53 disposed in a vertical direction, preferably, four fasteners, respectively. The fasteners 54, 55 may be of any conventional design; however, due to its flexibility and ability to accommodate imperfect mating, hook and loop type fasteners are considered to be preferred. The two fasteners 54 and 55 are positioned for mating engagement when the pad 40 is folded into a configuration as shown in FIG. 2, with the first face 44 confronting the front panel 14. Likewise, the two fasteners 53 and 45 are positioned for mating engagement when the pad 40 is folded in similar fashion as recited above.

The retaining strap 56 is provided to retain the pad 40 in either its first position or its second position. The retaining strap 56 is formed of a conventional flexible material which is sufficiently durable, such as woven nylon. However, the retaining strap 56 may also be formed with an elastic material which allows the strap to be stretched while the pad 40 lies in the second position. The retaining strap 56 has one end 58 thereof secured to the backpack 12 adjacent the top 18 of the front panel 14, and an opposite end 60 which is free. A center portion 57 of the retaining strap 56 is made of a separate stretchable material which provides for added flexibility and reduce thickness in the strap 56. The particular advantage of this material is it allows for twisting and stretching without permanent material deformation. Any material can be used for this particular feature so long as it provides the intended use as herein disclosed.

Attached to the end 60 of the strap 56 is a fastener 62 which is adapted to mate with one of two other fasteners. While the pad 40 is in the first position, the retaining strap 56 is positioned to secure the pad 40 to the backpack and the free end 60 thereof is wrapped beneath the backpack 12 so that the fastener 62 may mate with a fastener 66 attached to the back panel 16 (shown at FIG. 3). While the pad 40 is in the second position, the retaining strap is positioned to secure the pad 40 to chair seat, and the free end 60 is wrapped partially twisted around the seat so that the fastener 62 may mate with a fastener 64 attached to the first face 44 of the pad. Thus, the fasteners 64, 66 are of the same type since both are intended to mate with fastener 62. The fasteners 62, 64, 66 may be of any conventional design; however, due to its flexibility and ability to accommodate imperfect mating, hook and loop type fasteners are considered to be preferred.

Figure 3:
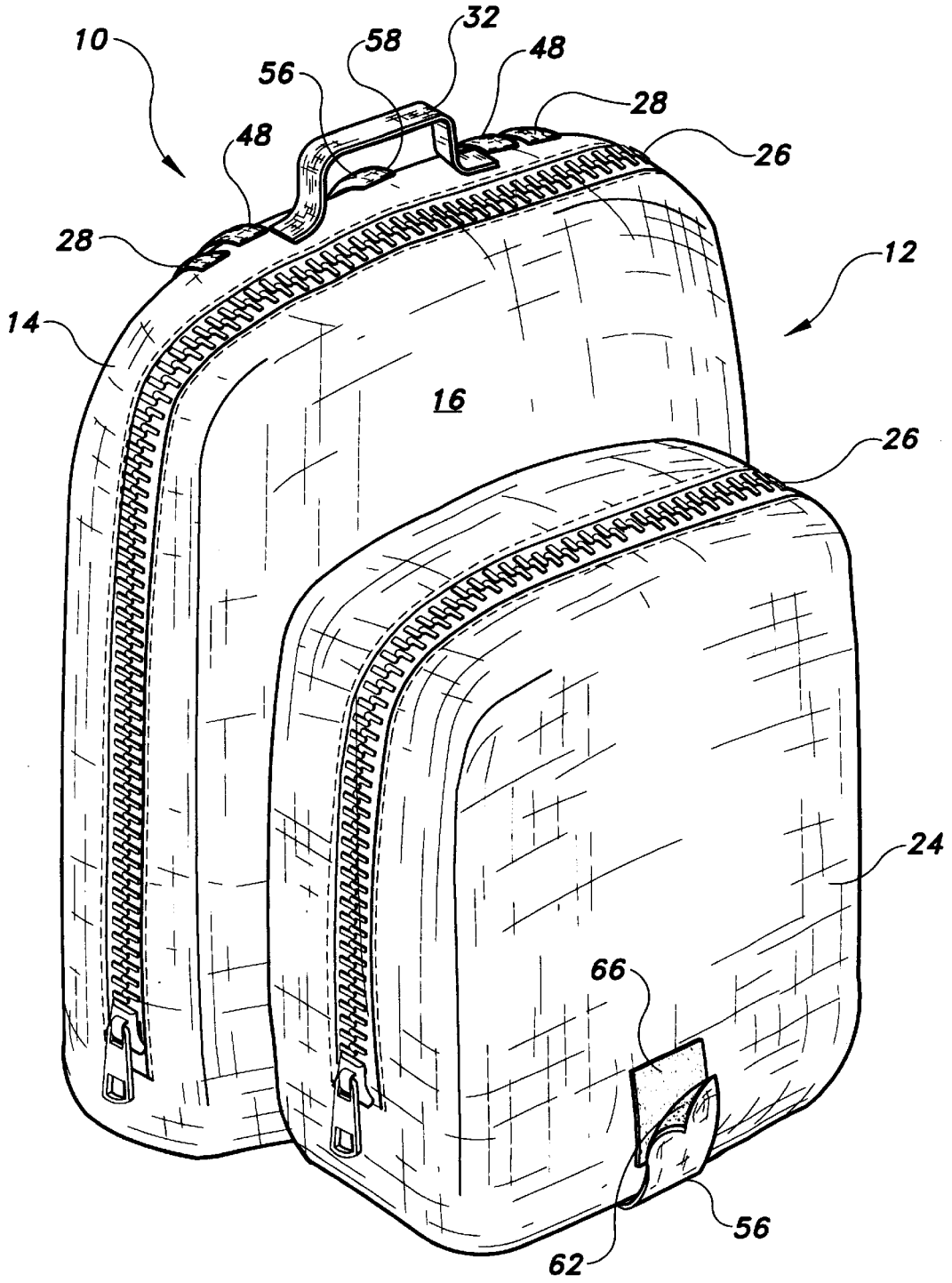
FIG. 3 is a front perspective view of the backpack assembly shown with a retaining strap fastened to a back panel of the pack in order to retain the pad against the pack in the first position.

Referring specifically now to FIGS. 2 and 3, the backpack assembly 10 is intended to be worn by a user with backpack 12 carried on his back. To carry the backpack assembly 10 on his or her back, a user will configure the pad 40 into the first position and retain the pad in such position with the retaining strap 56. To secure the pad 40 in the first position, the user will first lay the pad 40 against the backpack 12 such that the first face 44 of the pad confronts the front panel 14 of the backpack. With this accomplished, the fasteners 54 and 45 of the first face 44 will align and mate with the fasteners 55 and 57, respectively of the front panel 14. Next, the user will wrap the retaining strap 56 under the first face 44 of the pad, about the bottom 20 of the front panel 14, and partially over the back panel 16 until the fastener 62 aligns and mates with the fastener 66. Once retaining strap 56 is secured pad 40 as shown in FIG. 2.

Figure 4:
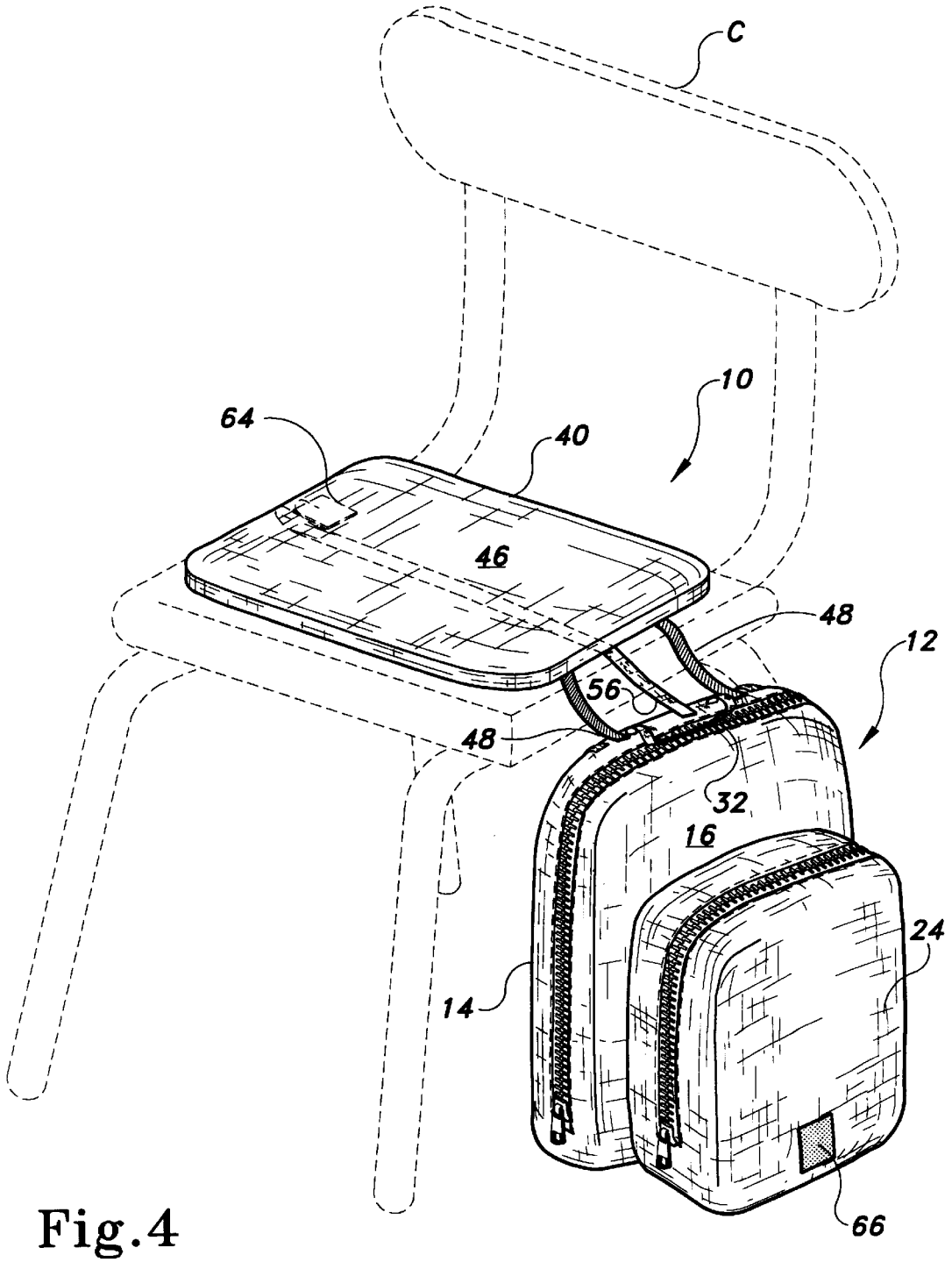
FIG. 4 is a front perspective view of the backpack assembly in use with a chair seat, having its pad placed in a second position with the retaining strap to be fastened to the pad.

Referring now to FIG. 4, the backpack assembly 10 also is intended to be utilized with the pad 40 serving as a seat cushion and the backpack 12 positioned conveniently beside a chair C (shown in phantom lines). To utilize the pad 40 as a seat cushion, a user will configure the pad 40 into the second position and retain the pad in such position with the retaining strap 56. Upon setting the backpack 12 upon a horizontal support surface (i.e., a floor), the retaining strap is removed from its position, and the fastener 62 is removed from the fastener 66. This allows the user to move the pad 40 from the first position to the second position, where the pad is placed onto a chair seat or the like. With the pad 40 placed onto the chair seat with second face 46 upwardly exposed, the user will then pull and twist the retaining strap 56 (which has been removed as recited above) beneath the chair seat and around the opposite side of the chair seat until the free end 60 of the retaining strap partially overlies the second face such that the fastener 62 aligns and mates with the fastener 64.

While the backpack assembly 10 has been shown in FIG. 4 to be placed beside the chair C with the retaining strap 56 extending from one side of the chair to the opposite side of the chair, it will be apparent to those skilled in the art that the backpack 12 may be placed onto the horizontal support surface at the front of the chair seat so that the retaining strap 56 extends from the front of the chair to the back of the chair in order to retain the pad 40 against the chair seat.

It is to be understood that the present invention is not limited to the sole embodiment described above, but encompasses any and all embodiments within the scope of the following claims.

We claim:

1. A backpack assembly adapted to be carried on the back of a person, the backpack assembly comprising:

a pack having a front panel, a back panel, and a chamber defined between said front and back panels, said front panel having a top, a bottom, and opposite sides;

a pair of shoulder straps secured to said pack such that, with said straps positioned over the shoulders of the person, said front panel faces and is generally parallel to the back of the person;

a pad having a first face and a second face, said pad being connected to said pack adjacent said top of said front panel, and being movable between a first position, with said first face contacting said front panel, and a second position, with said first face contacting a seating object; and retaining means connected to said pack for retaining said pad selectively in said first position and said second position, wherein said retaining means includes:

a retaining strap having a fixed end secured to said sack adjacent said top of said front panel and a free end;

first fastening means for fastening said free end of said retaining strap to said back panel while said pad is in said first position; and second fastening means for fastening said free end of said retaining strap to said pad while said pad is in said second position.

2. The backpack assembly according to claim 1, wherein said pad is secured to said pack by at least one strap, said at least one strap being connected at one end to said pack adjacent said top of said front panel and at its other end to said pad.

3. The backpack assembly according to claim 1, wherein said pad is secured to said pack by a plurality of straps, each of said plurality of straps being connected at one end to said pack adjacent said top of said front panel and at its other end to said pad.

4. The backpack assembly according to claim 1, wherein said first fastening means comprise:

a first fastener secured to said free end of said retaining strap; and a second fastener secured to said back panel, said second fastener being adapted to mate with said first fastener.

5. The backpack assembly according to claim 4, wherein said second fastening means comprise:

said first fastener; and a third fastener secured to said pad, said third fastener being adapted to mate with said first fastener.

6. The backpack assembly according to claim 5, wherein said third fastener is secured to said first face of said pad.

7. The backpack assembly according to claim 1, further comprising at least one third fastening means for fastening said first face of said pad to said front panel of said pack.

8. The backpack assembly according to claim 7, wherein said at least one third fastening means comprise:

a fourth fastener secured to said first face of said pad;

a fifth fastener secured to said front panel of said pack, said fifth fastener being adapted to mate with said fourth fastener.

9. A backpack assembly adapted to be carried on the back of a person, the backpack assembly comprising:

a pack having a front panel, a back panel, and a chamber defined between said front and back panels, said front panel having a top, a bottom, and opposite sides;

a pair of shoulder straps secured to said pack such that, with said straps positioned over the shoulders of the person, said front panel faces and is generally parallel to the back of the person;

a pad having a first face and a second face, said pad being secured to said pack by at least one pad strap, said at least one pad strap being connected at one end to said pack adjacent said top of said front panel and at its other end to said pad, said pad being movable between a first position, with said first face contacting said front panel, and a second position, with said first face contacting a horizontal supporting surface;

a retaining strap having a fixed end and a free end, said fixed end being secured to said pack adjacent said top of said front panel;

first fastening means for fastening said free end of said retaining strap to said back panel while said pad is in said first position, said retaining strap being positioned with said pad intemediate said retaining strap and said front panel of said pack; and second fastening means for fastening said free end of said retaining strap to said pad while said pad is in said second position.

10. The backpack assembly according to claim 9, wherein said first fastening means comprise:

a first fastener secured to said free end of said retaining strap; and a second fastener secured to said back panel, said second fastener being adapted to mate with said first fastener.

11. The backpack assembly according to claim 9, wherein said second fastening means comprise:

a first fastener secured to said free end of said retaining strap; and a third fastener secured to said pad, said third fastener being adapted to mate with said first fastener.

12. The backpack assembly according to claim 11, wherein said third fastener is secured to said first face of said pad.

13. The backpack assembly according to claim 9, further comprising at least one third fastening means for fastening said first face of said pad to said front panel of said pack.

14. The backpack assembly according to claim 13, wherein said at least one third fastening means comprise:

a fourth fastener secured to said first face of said pad;

a fifth fastener secured to said front panel of said pack, said fifth fastener being adapted to mate with said fourth fastener.

15. A method of using the backpack assembly of claim 9, the method comprising the steps of:

placing the backpack assembly beside a chair seat with the pad retained in the first position;

releasing the first fastening means to release the pad from the first position;

moving the pad into the second position by placing the pad onto the chair seat; and retaining the pad in the second position by passing the retaining strap beneath the chair seat and twisting said strap for fastening to the second fastening means.

* * * * *